US006157133A

United States Patent [19]

Shamamian et al.

[11] Patent Number: 6,157,133

[45] Date of Patent: Dec. 5, 2000

[54] METAL OXIDE DISCHARGE LAMP

[75] Inventors: Vasgen A. Shamamian, Alexandria, Va.; Daniel J. Vestyck, Jr., Danbury, Conn.; John L. Giuliani, Jr., Springfield; James E. Butler, Arlington, both of Va.

[73] Assignee: The United States of America as represented by the Secretary of the Navy, Washington, D.C.

[21] Appl. No.: 09/090,162

[22] Filed: Jun. 4, 1998

[51] Int. Cl.[7] ..... H01J 17/20; H01J 61/18; H01J 11/00

[52] U.S. Cl. ..... 313/638; 313/607

[58] Field of Search ..... 313/567, 568, 313/572, 574, 607, 608, 631, 637, 638, 643

[56] References Cited

U.S. PATENT DOCUMENTS

| | | | |
|---|---|---|---|
| 4,114,064 | 9/1978 | Ernsthausen | 313/188 |
| 4,205,392 | 5/1980 | Byrum, Jr. et al. | 365/116 |
| 4,451,765 | 5/1984 | Gray | 315/248 |
| 4,890,042 | 12/1989 | Witting | 315/248 |
| 5,086,258 | 2/1992 | Mucklejohn et al. | 315/248 |
| 5,158,709 | 10/1992 | Setti | 252/512 |
| 5,191,460 | 3/1993 | Lapatovich | 359/154 |

OTHER PUBLICATIONS

J. R. Coaton et al, "Tungsten–halogen lamps and regenerative mechanisms" by IEEE Proc., vol. 127, Pt., A, No. 3, Apr. 1980, pp. 142–148.

*Primary Examiner*—Ashok Patel
*Assistant Examiner*—Matthew J. Gerike
*Attorney, Agent, or Firm*—Barry A. Edelberg; John J. Karasek

[57] ABSTRACT

A sealed, metal oxide, electrodeless discharge lamp having a high emission intensity in the visible 400–700 nm range. Within the sealed container assembly of the lamp there is a source of metal atoms capable of forming a volatile oxide and a source of an oxygen containing gas. The lamp produces a plasma and volatilizes the metal into the plasma. Preferably the lamp is at a low pressure of about 20–40 torr and the metals are molybdenum or tungsten. Power is applied by inductively coupled electromagnetic radiation. A regenerative agent such as a halogen is added for recycling any deposited metal into the gas phase and to form a volatile compound with the source of metal atoms. The agent lowers the temperatures needed to volatilize the metal into the plasma. The lamp is operated by first providing energy at a low level to initiate the plasma and then supplying the metal atoms into the plasma.

23 Claims, 2 Drawing Sheets

METAL OXIDE DISCHARGE LAMP

BACKGROUND OF THE INVENTION

1. Field of the Invention

This invention relates to an electrodeless lamp which generates bright white emission from an oxygen containing plasma in contact with metal atoms such as molybdenum or tungsten.

2. Description of the Related Art

In spite of the large variety of lighting technologies available in the marketplace, there is still a need for efficient, large area illumination sources. At this time, there are two major forms of commercial light sources, filament lamps and discharge lamps. Within the discharge lamp classification, there are two sub categories of electroded (arc) and non-electroded lamps.

The essential advantages associated with the traditional incandescent (filament) lamp are the excellent color rendering indices produced by the hot filament. However, the superior color balance is obtained at the expense of the luminous efficiency. Since the filament essentially acts as a black body radiator at 2500–3000° C., most of the radiant energy is expended in the form of infrared radiation, which is undetectable to the human eye. Furthermore, the large output of IR radiation introduces an additional engineering complexity with respect to the lamp housing in the form of special dichroic coatings that selectively reflect or transmit visible light. Another significant limitation of filament lamps is associated with operational lifetime due to thermal erosion of the filament. The addition of halogens to the inert gas fill has certainly extended the lifetimes of the filament through catalytic cycling of the metal from the walls. However, failure ultimately occurs from re-deposition of filament material to cooler spots in the lamp. Finally, since the hot filament is spatially very small, the lamps act primarily as point sources. Therefore, illuminating large areas becomes problematic and inefficient, and arrays of bulbs are generally employed.

Electrode discharge lamps, such as traditional fluorescent lighting, suffer from the same problem of electrode erosion as filament lamps. To make matters worse, these lamps employ mercury vapor as the primary emitter. Mercury has known toxic effects on humans, and it is considered a severe environmental pollutant. Therefore, it is anticipated that future disposal problems will only become worse as population pressures intensify in urban and suburban areas. Mercury emits radiation in distinct lines, the strongest of which lie in the ultraviolet (UV) at 254 nm. Hence, the color rendering of most mercury-based lamps is enhanced by coating the inside of the glass bulbs with a phosphor, which absorbs the UV and re-emits in the visible spectrum. While this technology improves the color balance, the quantum efficiency of the phosphor is near unity, so that one UV photon is converted to one visible photon and heat. Thus, energy efficiency is compromised. Finally, the phosphors themselves are composed of rare earths and may pose potential environmental remediation problems.

One modification of the discharge lamp that alleviates electrode failure is to inductively couple the power into the working gas. Most of these commercial electrodeless lamps still rely on mercury based chemistries and continue to suffer from all the same limitations described above. One notable exception is a sulfur based illumination source. This lamp has excellent color balance and good efficiency, however it operates as a compressed discharge at high pressure and power density. Consequently, the lamp demands active cooling. As a point source it is akin to the filament lamp, and, hence, poor for large area lighting. The technological solution that has been employed in the art is to fabricate light pipes, which degrade the illumination due to transmission losses.

3. Objects of the Invention

It is an object of this invention to provide a discharge lamp which contains no mercury.

It is a further object of this invention to provide a discharge lamp which contains no active electrode.

It is a further object of this invention to provide a discharge lamp which is environmentally safe and less toxic to humans.

It is a further object of this invention to provide a discharge lamp which uses inductively coupled radio frequency power.

It is a further object of this invention to provide a discharge lamp which operates at low pressure.

It is a further object of this invention to provide a discharge lamp which is an extended illumination source.

It is a further object of this invention to provide a discharge lamp which has improved color balance.

It is a further object of this invention to provide a discharge lamp which has improved luminous efficiency.

It is a further object of this invention to provide a discharge lamp which scales to large area.

It is a further object of this invention to provide a discharge lamp which does not require any phosphors.

It is a further object of this invention to provide a discharge lamp which uses a gas source that is very inexpensive.

These and further objects of the invention will become apparent as the description of the invention proceeds.

SUMMARY OF THE INVENTION

A metal oxide electrodeless discharge lamp has a container assembly capable of passing light to the outside of the container and metal-containing species within the container assembly, where the metal is capable of forming a volatile metal oxide and where the lamp when operated has an emission intensity in the visible 400–700 nm range. The lamp further contains an oxygen-containing gas and the lamp is capable of producing a plasma within the container assembly and volatilizing the metal into the plasma. In the preferred embodiment the lamp is at below atmospheric pressure, e.g. about 20–40 torr. The preferred metals are molybdenum and tungsten (particularly molybdenum). However other metals (such as barium) may be used, and may add color balance to the lamp when used in conjunction with the preferred metals. The lamp produces a very bright light: when measured by the integrated emission intensity in the visible 450 to 700 nm region, it is increased by a factor of 10 compared to lamps without this metal-containing species. More commonly, there is an increase by a factor of greater than 50.

The lamp container can be made of glass or quartz.

In an especially preferred embodiment there is an additional regenerative agent within the container which is capable of removing deposited metal on the container walls for recycling into the gas phase and which is also capable of forming a volatile compound with the metal. The use of this agent will lower the temperatures needed inside the lamp to volatilize the metal into the plasma. A preferred regenerative agent is a halogen gas (fluorine, chlorine, bromine, iodine, and combinations thereof). The halogen gas may be supplied in another phase (liquid or solid) if the operating temperature of the bulb is high enough for a significant vapor pressure. Skilled practitioners will refer to the developed art of halogen lamps for teachings on including halogen gases in a lamp.

The lamps are operated by first providing energy to initiate the plasma and then supplying the metal atoms into the plasma. The introduction of the metal atoms can be done by, e.g., heating the surface of the metal atoms in the container assembly to a temperature high enough (e.g., about at least 700° C.) to provide metal atoms in the plasma, or by volatilizing a metal compound such as an oxide used as the source of metal atoms in conjunction with the use of the regenerative agent.

The principle advantages to this lamp technology are that it contains no mercury, and no active electrode. It is therefore environmentally safe and less toxic to humans. The combination of operation by inductively coupling radio frequency power and low pressure implies that the lamp has potential as an extended area illumination source which eliminates the multiple shadows from traditional grid style lighting. There are no phosphors required, and finally, the gas sources are very inexpensive.

DESCRIPTION OF THE PREFERRED EMBODIMENTS

A lamp has been designed which is an electrodeless white light source generated in the preferred embodiment by an oxygen/nitrogen plasma in contact with a hot molybdenum metal plate. The principal advantage of this lamp is that it does not require the use of mercury vapor which is an environmentally hazardous material with known human toxicity. The second advantage is its potential to become a low pressure extended illumination source without the use of filaments, arc electrodes, or phosphors.

Figure 1:
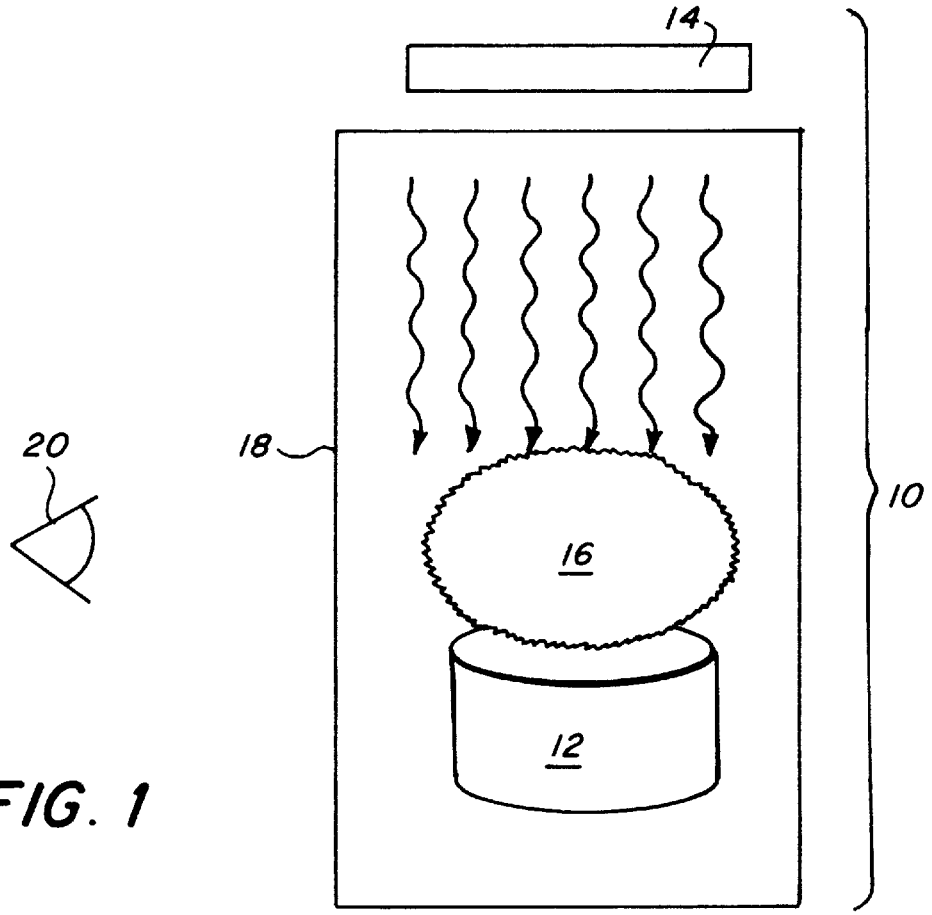
FIG. 1 illustrates components of an embodiment of the lamp.

FIG. 1 illustrates the structure of one embodiment of the lamp 10. The components are a heated molybdenum stage 12, a microwave source 14 for inducing an $N_2$+$O_2$ plasma 16, and a sealed bulb 18 for containing the metal vapor and the plasma. To measure the output of the device an optical detector 20 can be used to measure the intensity and spectral features in the visible range. The lamp assembly preferably is maintained at a low pressure of about 20 to 40 torr. Pressure is a variable which will be exploited in alternative embodiments which is contemplated to go as high as one atmosphere pressure (760 torr) and as low as 1 torr. Since the physical size of the plasma due to diffusion is a stronger function of pressure than the emission characteristics, there is potential to scale the invention to larger dimensions and produce large area illumination sources.

In one embodiment the heated molybdenum substrate can be in the form of an RF induction coil which is surrounded by a graphite puck upon which the molybdenum stage rests. Under normal operating conditions, the temperatures at which the molybdenum surface is exposed to the plasma were varied between 200° C. and 800° C. The gas mixture in the lamp is produced by adding equal volumes of $O_2$ and $N_2$ until the desired pressure in the chamber reaches about 20–40 torr. The chamber can then be sealed and the microwave power initiated, thus igniting the discharge. Typically, 100–300 watts at 2.45 GHz are coupled into the gas. When the stage is relatively cold at 200° C. the plasma generally appeared pinkish white due to emission from the high vibronic bands of the $N_2$ first positive transition. After the system is allowed to reach stability (typically 5 minutes in the early experimental work), the stage heater is engaged and the temperature raised to 700° C. At this point, there is a sudden transition to a bright white light. While not wanting to be bound by any specific theory, a suggested mechanism which appears to explain the strong change in the spectral emission with respect to the molybdenum surface temperature is as follows: (1) the plasma dissociates $O_2$ into O atoms, (2) the O atoms impinge on the metal surface and form an oxide layer, (3) at elevated temperatures the volatile metal oxide desorbes as $MoO_3$ or $MoO_2$ into the gas phase, and (4) through collisions with electrons, the plasma excites the electronic states of Mo, MoO, and other species, which then radiate and add to the existing background emission of $N_2$ and $N_2^+$. Experimental evidence which supports this mechanism is as follows.

Figure 2:
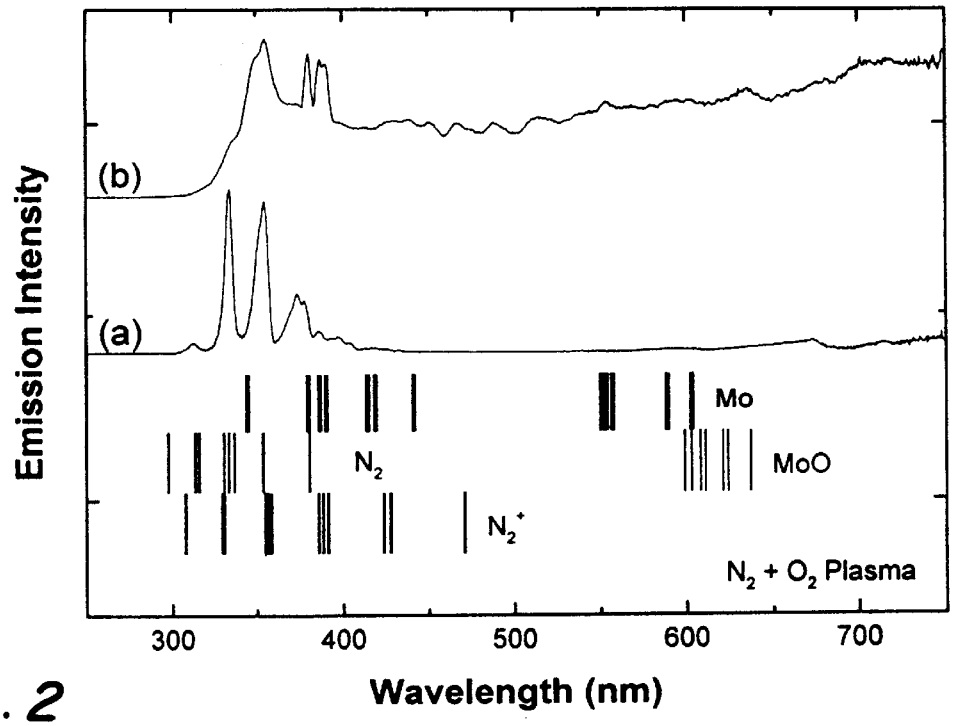
FIG. 2 compares the optical spectrum of an $N_2$+$O_2$ plasma with (a) the molybdenum surface at room temperature and (b) the plasma with the molybdenum surface held at 700° C. to line assignments of known gas phase species.
Figure 3:
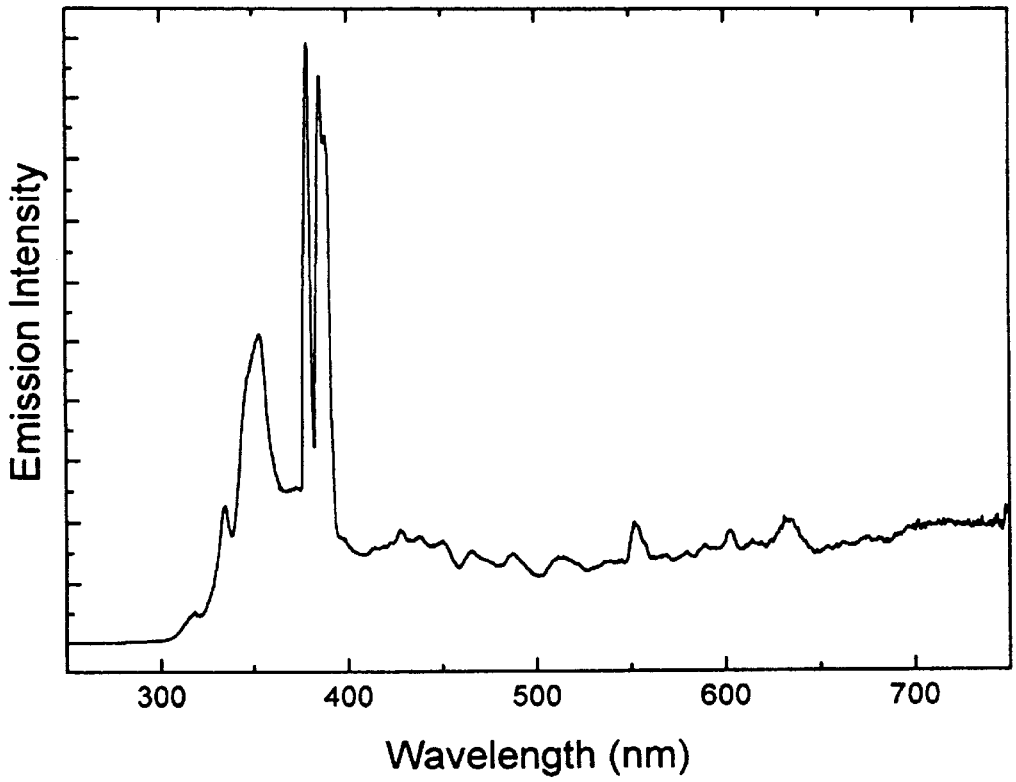
FIG. 3 displays the optical spectrum of an $N_2$+$CO_2$ with the molybdenum surface held at 700° C.

FIG. 2 compares the optical spectrum of the plasma when the molybdenum surface is heated from 200° C. (dim mode, curve a) to 700° C. (bright mode, curve b). The spectra are corrected for the spectral response of the detector and collection optics. It is clear that the wavelength range corresponding to the photopic response of the human eye (400–700 nm) enjoys a significant increase in the emission intensity. The integrated emission intensity in the 450 to 700 nm region is increased by a factor 10 and more preferably by a factor of greater than 50 compared to when no metal is introduced into the gas phase. The emission is either continuum in nature, resulting from gas phase cluster formation, or is densely populated with atomic and molecular transitions. In the dim mode, curve a, we observe banded emission in the 300–400 nm range which are assigned to the rotational bandheads of the $N_2$ second positive ($C^3\Pi_u \rightarrow B^3\Pi_g$) and the $N_2^+$ molecular ion first negative ($B^2\Sigma_u \rightarrow X^2\Sigma_g$) vibronic transitions. Below the spectra in FIG. 2 are histograms markers which indicate the position of the more intense transitions. In the bright mode, we observe the addition of several atomic Mo emission lines, also indicated by histograms. Furthermore, if the molybdenum surface is masked with nonvolatile material, such as silicon, it is impossible to generate a bright plasma displayed in FIG. 2*b*. Finally at electron temperatures characteristic of the discharge, approximately one electron volt, model calculations suggest that the emission of atomic Mo is dominated by transitions in the photopic range of the visible spectrum. Furthermore, the mechanism is not dependent on the particular frequency driving the plasma such as a standard radio frequency of 13.56 MHz.

There are many alternative approaches and parameters to vary to obtain the same significantly improved optical properties of this illumination concept.

The first possibility is to employ a different oxygen bearing gas such as $CO_2$. When $CO_2$ has been used to replace $O_2$ we have observed no significant change in the plasma emission spectrum. A problem associated with the use of $CO_2$ as an oxidizer, however, is that the carbon tends to plate out (i.e., deposit onto surfaces within the bulb).

Other oxygen-containing gases which will be sufficient to produce the desired effect may be used, such as carbon monoxide, water vapor, and nitrous oxide. Oxygen-containing gases may be combined. Furthermore, additional gases may be combined with the oxygen containing gases to act as diluents and perhaps to add to the color balance of the lamp. However, it has been found that the lamp typically works better with sufficient oxygen, so it is preferred to have at least 40 atomic percent oxygen (or more preferred to have at least 50 atomic percent oxygen) in the gas mixture. Nitrogen and the noble gases (particularly argon) will be suitable additional gases. Examples of gas mixtures for making the plasma are nitrogen and oxygen or nitrogen and carbon dioxide.

The metal-containing species, including species containing the preferred metal molybdenum, can be in the form of a metal or metal alloy, or a metal compound such as an oxide or salt. The metal-containing species can be a light-transmitting coating on the inside of the container, or elsewhere in the container. Combinations of metal-containing species may be used.

Another possibility is to operate the device at a different frequency. The initial choice of 2.45 GHz was chosen for laboratory convenience. However, other frequencies such as 13.56 MHz, or any other radio frequency, will also work. Lower frequencies have a longer wavelength, and may have better potential at scaling to extended sources. Probably a major consideration when selecting a frequency for a commercial device will be to operate in the FCC allowed microwave and radio frequency bands such as 2.45 GHz, 13.56 MHz, and below 5 MHz.

In combination with different frequencies, it may be advantageous to operate the device in a pressure range outside of those specified above. The physical size of the plasma will be dictated by the radiating gas phase species, the rate of diffusive losses to the bulb wall, and the wavelength and field strength of the radio frequency radiation coupled to the working gas. Since the plasma emission characteristics are insensitive to the pressure over the range interrogated, it is possible to exploit this effect to create large area illumination sources.

In the same manner as in the tungsten halogen lamps, there is a need in a preferred embodiment to generate a volatile chemical species that will assist in the transport of molybdenum oxides from cold surfaces around the lamp bulb to the gas phase to prolong lamp lifetime. See, for example, ATungsten-halogen lamps and regenerative mechanisms" by J. R. Coaton et al, IEEE Proc., Vol. 127, Pt., A, No. 3, April 1980, pp. 142–148. Chemical transport agents such as halogens are likely candidates. The purpose of the regenerative mechanism is to produce volatile intermediates such as molybdenum oxyhalides, $MoO_2X_2$, or $MoO_3X$ where X=Cl, Br, and I which will desorb from surfaces at much lower temperatures than the pure oxides. Boiling point data suggests that temperatures as low as 100° C. may be sufficient to volatilize the oxychlorides and transport the Mo atoms into the gas phase.

Molybdenum oxides in powder or film form used in combination with halogens can be substituted for molybdenum metal as an inexpensive source of the Mo atom, thus obviating the need for a heated stage. These halides in combination with powders form volatile intermediates such as molybdenum oxyhalides, $MoO_2X_2$, or $MoO_3X$ where X=Cl, Br, and I, which will desorb from surfaces at much lower temperatures than the pure oxides. Again, boiling point data suggests that temperatures as low as 100° C. may be sufficient to volatilize the oxychlorides and transport the Mo atoms into the gas phase.

Figure 4:
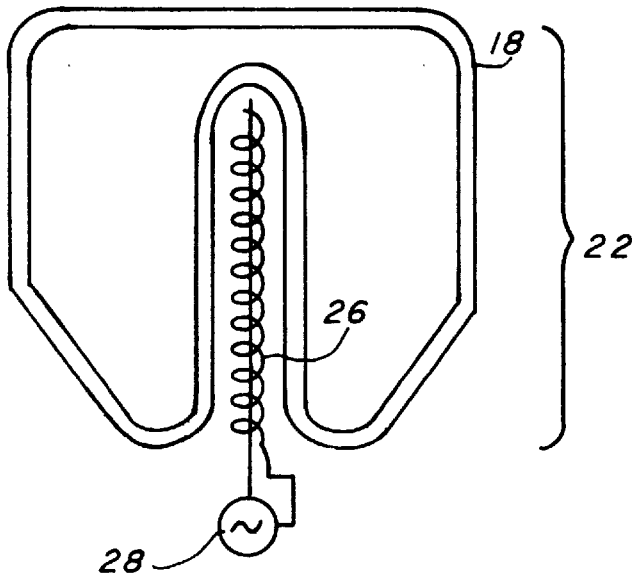
FIG. 4 depicts another embodiment of the lamp.

In another preferred embodiment of the invention depicted in FIG. 4, a lamp 22 has a sealed bulb 18 with a light-transmitting internal coating 24 of a metal containing species such as $MoO_3$ or $TiO_2$. An rf coil 26 is positioned to induce a plasma in the bulb. The coil 26 may be outside of the enclosed volume of the bulb 18 as shown here, or the coil may be within the bulb. The coil is connected to an oscillating power source 28 for driving the coil. The internal volume of the bulb is preferably filled with roughly equal volumes of $N_2$ and $O_2$, with enough $X_2$ (X=F, Cl, Br, or I) to help volatilize the metal oxide. In operation, the coil induces the plasma and provides any heat needed to help volatilize the metal.

Having described the basic aspects of the invention, the following examples are given to illustrate specific embodiments thereof.

EXAMPLE 1

This example illustrates the operation of a simple lamp embodiment according to the present invention.

In the lamp housing an RF induction coil is surrounded by a graphite puck and upon this a molybdenum substrate rests. The container assembly is evacuated and then a gas mixture of equal volumes of $O_2$ and $N_2$ were added until the desired pressure in the chamber of about 30 torr was reached. The chamber is then sealed and microwave power is coupled into the gas, which ignites the plasma discharge. Typically, 100–300 watts at 2.45 GHz are coupled into the gas.

When the Mo metal surface temperature is held at 200° C., a plasma appears pink-white, due to a emission from the high vibronic bands of the $N_2$ first positive transition. The optical spectrum of this darker plasma is given in FIG. 2*a*. The system reaches stability in about 5 minutes. Then the stage heater was engaged and the temperature was raised to 700° C. At this point, a sudden transition to a bright white light was observed and the spectrum changes from FIG. 2*a* to FIG. 2*b*.

EXAMPLE 2

This example illustrates another embodiment of the invention using $CO_2$ as the source of the oxygen containing gas.

Equal mixtures of carbon dioxide and nitrogen as the working gas are employed in a system similar to Example 1. A plasma is ignited under the same conditions as FIG. 2*a* and similar emission as the bright mode in FIG. 2*b* is recorded with the detector when the temperature is increased by the stage heater. The reason for the same characteristic emission profile is because the same mechanism responsible for the oxidation and volatilization of Mo in the $N_2$+$O_2$ plasma is at work in this case. In this example the O atoms are supplied to the surface from the gas phase dissociation of $CO_2$. These results suggest that any oxygen bearing gas, such as $NO_2$ which yields upon dissociation oxygen atoms, will be sufficient to produce the desired effect.

It is understood that the foregoing detailed description is given merely by way of illustration and that many variations may be made therein without departing from the spirit of this invention.

What is claimed is:

1. A metal oxide electrodeless discharge lamp comprising:

a) a container assembly capable of passing light to the outside of said container;

b) a metal-containing species within said container assembly, said metal being capable of (i) forming a volatile oxide and (ii) having an emission intensity in the 400–700 nm range;

c) an oxygen-containing gas within said container assembly; and d) an oscillating field source for producing a plasma within said container;

wherein said metal is molybdenum, tungsten, barium, or combinations thereof; and wherein said molybdenum-containing species is $MoO_3$ or $MoO_2$.

2. A lamp according to claim 1, wherein the integrated emission intensity in the 450 to 700 nm region is increased by a factor of 10 compared to a lamp without said metal-containing species.

3. A lamp according to claim 1, wherein the integrated emission intensity in the 450 to 700 nm region is increased by a factor of greater than 50 compared to lamp without said metal-containing species.

4. A lamp according to claim 1, wherein said plasma comprises said oxygen-containing gas selected from the group consisting of oxygen, carbon dioxide, carbon monoxide, water vapor, nitrous oxide, and combinations thereof, and further comprising an inert gas selected from the group consisting of nitrogen and the noble gases.

5. A lamp according to claim 1, wherein said plasma comprises nitrogen and said oxygen-containing gas selected from the group consisting of oxygen and carbon dioxide.

6. A lamp according to claim 1, wherein said container assembly is made of glass or quartz.

7. A lamp according to claim 1, wherein said molybdenum-containing species is molybdenum metal.

8. A lamp according to claim 3, further comprising a heater for heating said molybdenum.

9. A lamp according to claim 1, wherein said plasma consists essentially of nitrogen and oxygen.

10. A lamp according to claim 9, wherein said plasma is at least about 40 atomic percent oxygen.

11. A lamp according to claim 9, wherein said plasma is at least about 50 atomic percent oxygen.

12. A lamp according to claim 1, further comprising:

e) a regenerative agent within said container assembly, wherein said regenerative agent is (i) capable of removing deposited metal on the walls of said container, and (ii) capable of forming a volatile compound with said metal.

13. A lamp according to claim 12, wherein said container assembly is further capable of maintaining an internal pressure of about 20–40 torr.

14. A lamp according to claim 12, wherein said regenerative agent is a halogen gas.

15. A lamp according to claim 12, wherein said metal is molybdenum, tungsten, barium, or combinations thereof.

16. A lamp according to claim 1, wherein said metal-containing species is a metal.

17. A lamp according to claim 1, wherein said metal-containing species is a metal compound.

18. A lamp according to claim 17, wherein said metal compound is a metal oxide.

19. A lamp according to claim 17, wherein said metal compound is a metal salt.

20. A lamp according to claim 1, wherein said metal-containing species is a coating on said container assembly, and is capable of passing light to the outside of said container.

21. A lamp according to claim 1, wherein said oscillating field source operates at a radio or microwave frequency.

22. A lamp according to claim 1, wherein at least 50 atomic percent of the metal in said metal containing species is molybdenum.

23. A method of operating a metal oxide discharge lamp according to claim 1, comprising:

a) providing an oscillating field to initiate said plasma.

* * * * *